United States Patent [19]

Hume, deceased et al.

[11] Patent Number: 4,686,876

[45] Date of Patent: Aug. 18, 1987

[54] APPARATUS FOR CUTTING SHEET MATERIAL

[75] Inventors: Kenneth J. Hume, deceased, late of Chalfont St. Giles, by Catherine G. Hume, executor; Laurence N. Ogborne, Colmworth, both of United Kingdom

[73] Assignee: Rotatrim Limited, Luton, England

[21] Appl. No.: 808,157

[22] Filed: Dec. 12, 1985

[30] Foreign Application Priority Data

Dec. 21, 1984 [GB] United Kingdom ..... 8432448
Nov. 15, 1985 [EP] European Pat. Off. ..... 85308356.6

[51] Int. Cl.[4] ..... B26D 1/20

[52] U.S. Cl. ..... 83/455; 83/464; 83/471.2; 83/508; 83/698; 83/824

[58] Field of Search ..... 83/471.2, 485, 489, 83/491, 508, 451, 455, 464, 453, 824, 825, 698; 269/4, 244

[56] References Cited

U.S. PATENT DOCUMENTS

| | | | |
|---|---|---|---|
| 630,019 | 8/1899 | Worthen | 83/455 |
| 992,755 | 5/1911 | Crocker | 83/455 |
| 1,194,058 | 8/1916 | Neumayer | 269/4 |
| 2,317,195 | 4/1943 | Husted | 269/244 X |
| 3,821,915 | 7/1974 | Larrable | 83/489 X |

*Primary Examiner*—E. R. Kazenske
*Assistant Examiner*—Hien H. Phan
*Attorney, Agent, or Firm*—Walter H. Schneider

[57] ABSTRACT

Apparatus for cutting sheet material has a cutting blade on a carriage which is displaced along a guide member to co-operate with a fixed blade. The apparatus is removably mounted on a structure which provides a support surface for the material to be cut and, to this end, there are clamping means for removably securing the cutting apparatus to the structure.

2 Claims, 6 Drawing Figures

APPARATUS FOR CUTTING SHEET MATERIAL

This invention relates to apparatus for cutting sheet material, such as paper, cardboard and the like. There are many applications in offices, laboratories and similar work places where it is necessary to cut sheet material.

Apparatus for cutting sheet material is known which consists of a carriage displaceable along an elongate guide member. The carriage includes a cutter which co-operates with a fixed blade to sever sheet material positioned between them. In the known apparatus, a baseboard is included which supports the sheet material to be cut and the guide member is supported directly or indirectly from the baseboard. It has now been appreciated that, in some applications, a baseboard is not required.

According to a first aspect of the present invention, apparatus for cutting sheet material comprises an elongate beam; a pair of head structures mounted on opposite ends of the beam; an elongate guide member extending from one head structure to the other head structure; a carriage mounted on the guide member and displaceable therealong; a cutting blade mounted on the carriage; and each head structure including clamping means for temporarily clamping the head structure to a separate rigid device, which provides a flat work surface for supporting the material to be cut.

According to a second aspect of the present invention, apparatus for cutting sheet material comprises an elongate beam having a flat upper surface; a pair of head structures securely positioned at opposite ends of the beam; a guide member extending from one head structure to the other; each head structure having a fixed jaw, a movable jaw and means for positioning the movable jaw with respect to the fixed jaw to temporarily clamp the head structure to the edge of a separate table or the like with said upper surface of the beam flush with the surface of the table or the like, and said guide member overlying the surface of the table or the like; a carriage mounted on the guide member and being displaceable along the length thereof; a roller located in a channel defined by said guide member and in frictional engagement therewith whereby displacement of the carriage rotates said roller; and a circular cutting blade mounted for rotation with said roller and arranged in overlapping relation with a fixed blade on said beam whereby sheet material arranged on the surface of the table beneath the guide member and overlying the fixed blade is severed by the rotating blade as the carriage is displaced along the guide With these arrangements, the apparatus can readily be removably clamped to a support table in a work place or to a machine which requires sheet material to be cut into lengths either before or after being processed in the machine.

Each clamping means conveniently comprises a pair of jaws, one of which is fixed and the other of which is movable towards and away from the fixed jaw, to thereby adjust the separation of the jaws so that the head structures can be removably clamped to the support table or the like. In each head, the movable jaw may be moved towards and away from the fixed jaw by a device including a screw on which a nut on the movable jaw is mounted. By rotating the screw, the movable jaw is moved relative to the fixed jaw. P In order that the invention may be more readily understood, it will now be described, by way of example only, with reference to the accompanying drawings, in which:

Figure 1:
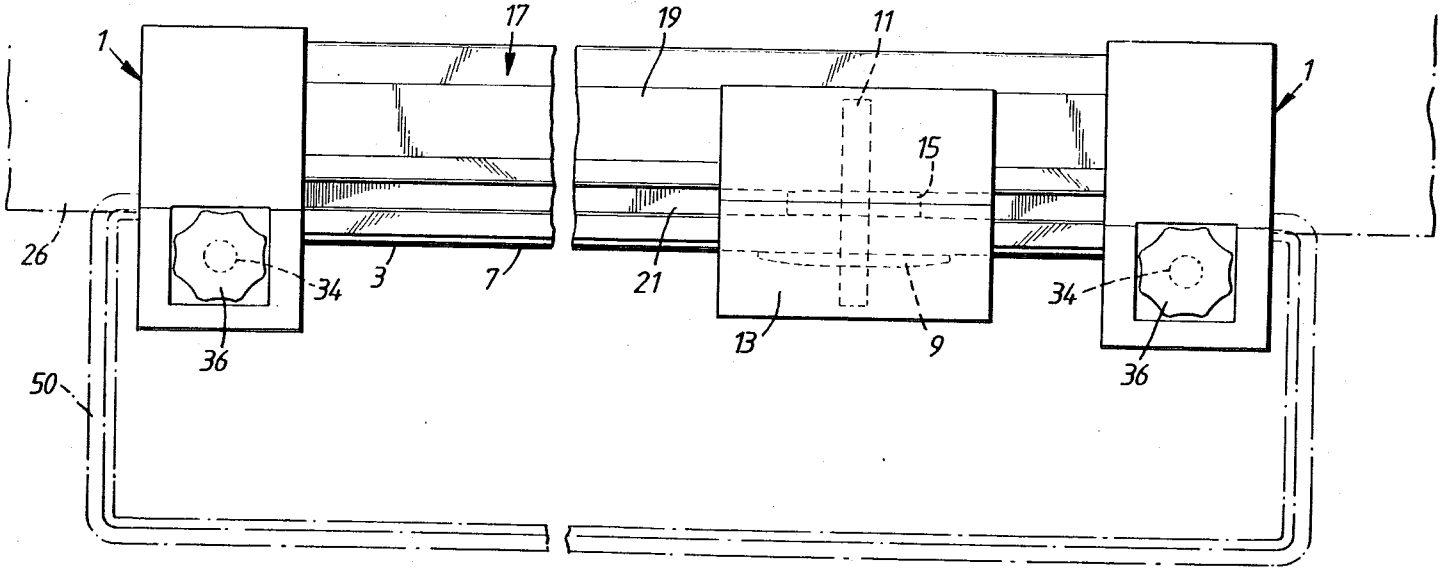
FIG. 1 is a plan view of apparatus in accordance with the invention.
Figure 2:
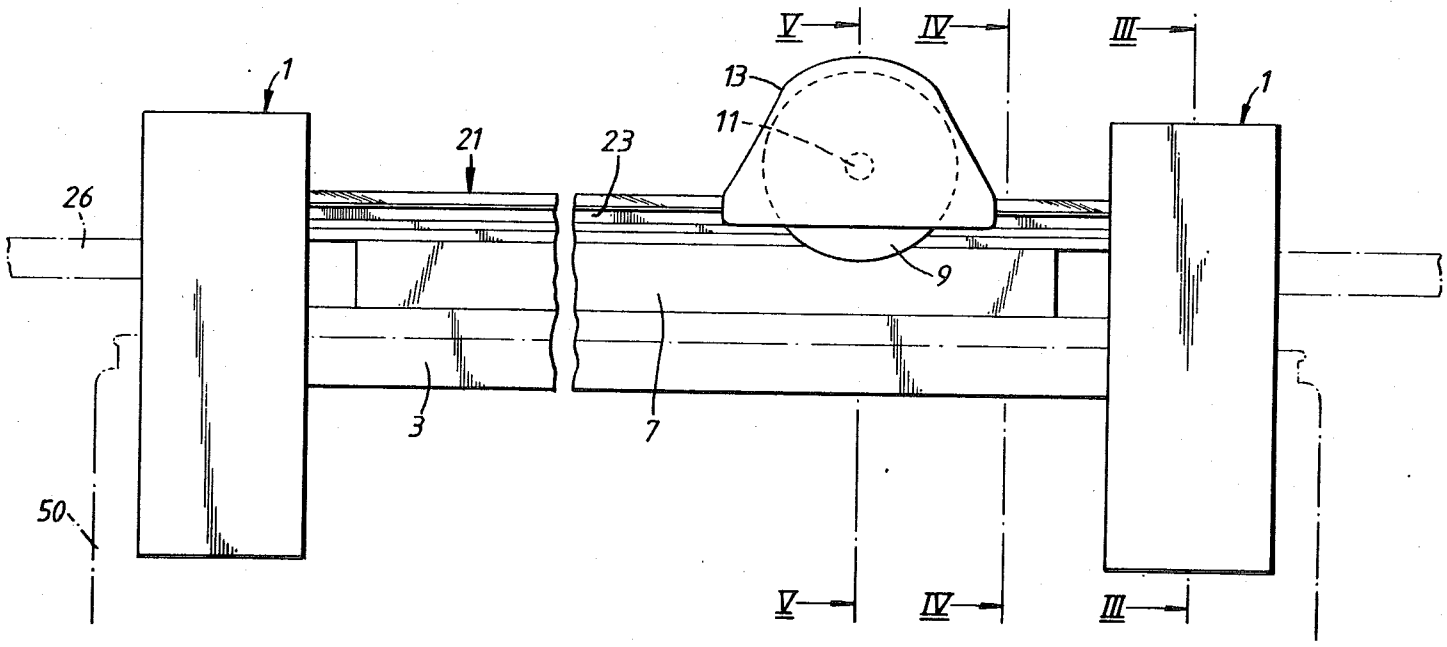
FIG. 2 is a rear elevation.

Apparatus for cutting sheet material, such as paper, cardboard, plastics, foil and the like, consists of a pair of shaped heat structures 1 securely positioned at opposite ends of an elongate rigid beam 3. The beam is of generally rectangular cross-section and a notch 5 is formed in the upper surface of the beam. An elongate blade 7 is fitted in this slot. A circular cutter blade 9 has one face adjacent its periphery urged against the flat blade 7 so that the flat fixed blade and the circular blade are in cutting relationship with each other and the circular blade will cut through sheet material arranged to overlie the upper edge of the blade 7.

The cutter blade 9 is mounted on a bush 10 rotatably mounted on a spindle 11 located in a carriage 13. The bush 10 also carries a drive roller 15, conveniently of rubber, which is of lesser diameter than the diameter of the cutter 9. A clamp strip 17, conveniently of clear plastics material, extends between the head structures 1. This strip includes a flat portion 19 having an upwardly projecting edge and an integral channel portion 21 on its upper surface. On each of the two lateral sides of the channel portion 21 there is a longitudinally extending groove 23 into which project portions of the carriage 13 so that the carriage is retained on the clamp strip. The carriage is slidable along the strip 17 which serves as a guide for the carriage. The drive roller 15 projects into the channel of the channel portion and, as the carriage is displaced along the strip, friction between the drive roller and the wall of the channel causes the roller 15 and the cutter wheel 9 to be rotated.

Before the apparatus can be used, it is necessary to mount it on a rigid structure which provides a flat working surface for supporting the material to be cut. The structure with the flat working surface is indicated in broken lines by reference 26. The structure is positioned immediately below the strip 17 and abuts against the beam 3 so that the upper surface of the blade 7 is flush with the work surface of the support. To enable the apparatus to be removably clamped to the structure, each of the heads 1 has a pair of jaws between which the structure is clamped. As can be seen particularly from FIGS. 3 and 4, each head has a fixed upper jaw 30 and a lower jaw 32 which is movable towards and away from the upper jaw to thereby adjust the separation of the jaws so that the heads can be removably clamped to the structure which provides the work surface. Pads 30A and 32A are let into the opposite surfaces of the upper and lower jaws so as not to damage the work surface.

The lower jaw on each head is provided with a threaded nut which is mounted on a screw 34 rotatably mounted in the head. Thus, on rotating the screw, the lower jaw is caused to move either towards or away from the upper jaw, depending upon the direction of rotation of the screw. The screw is operated manually.

Figure 3:
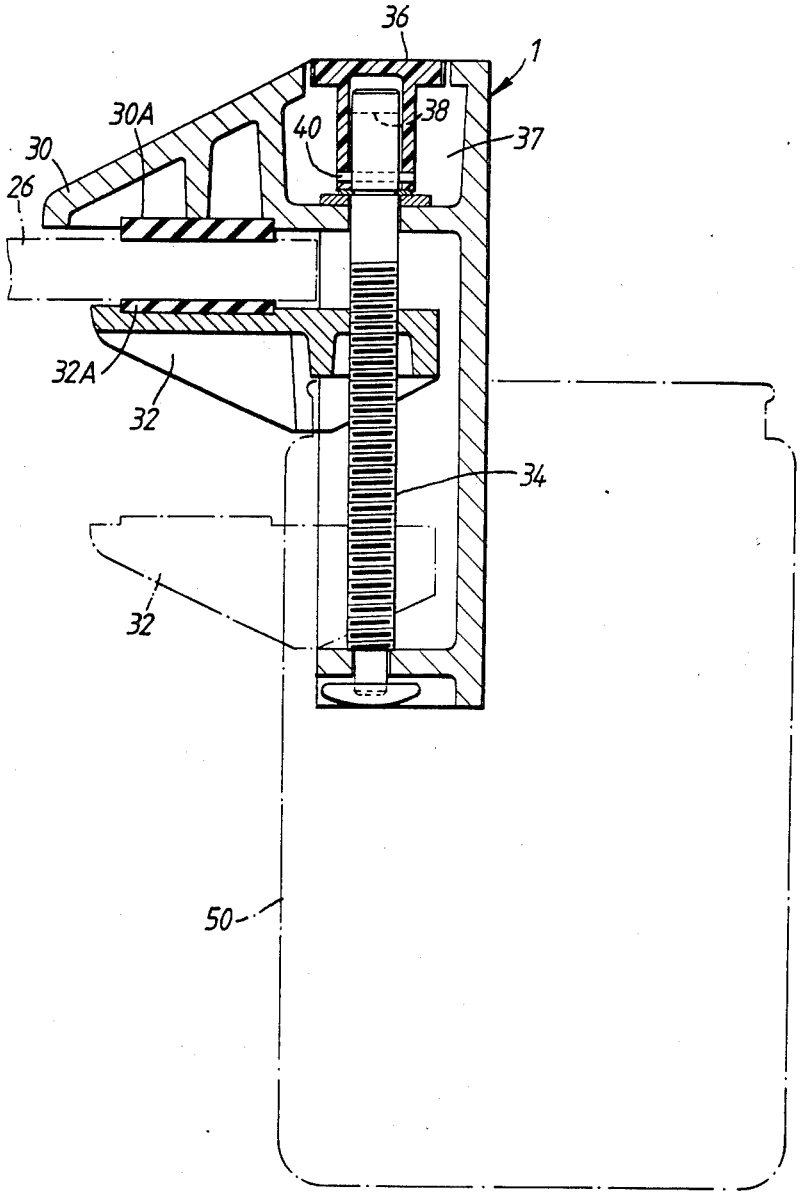
FIGS. 3, 4 and 5 are sections on the lines III—III, IV—IV and V—V of FIG. 2, respectively.
Figure 4:
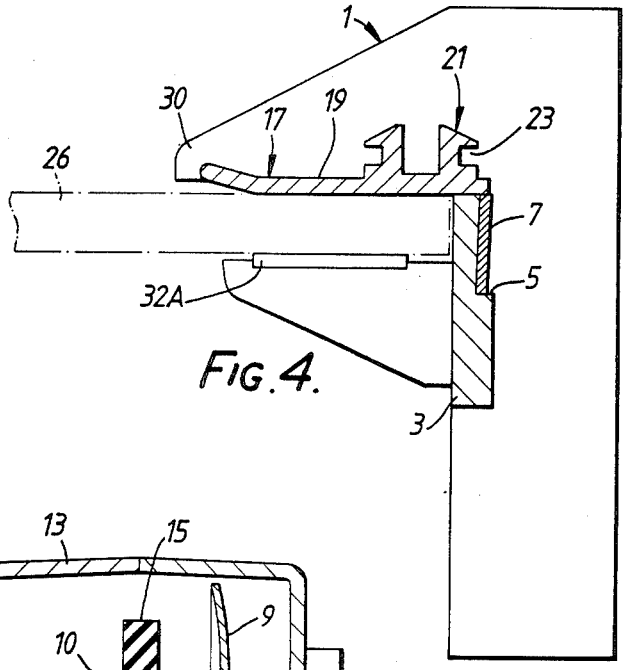
Figure 5:
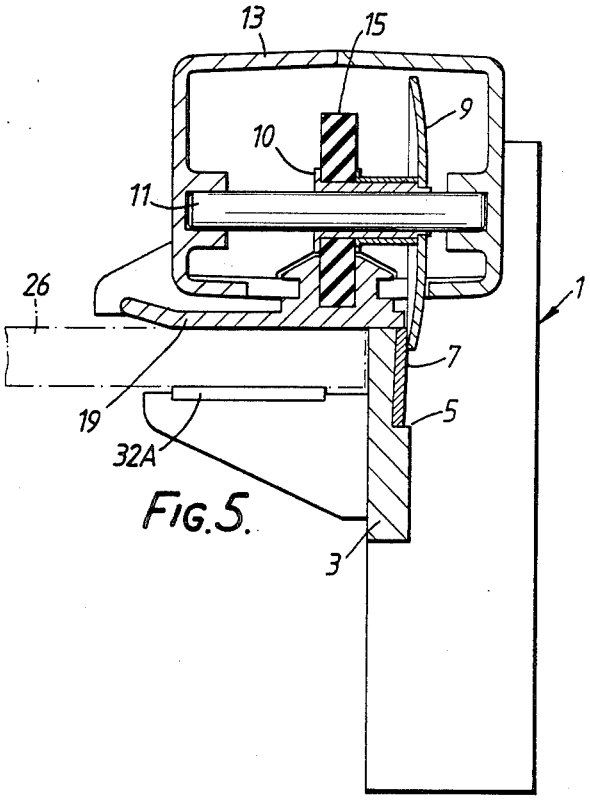
Figure 6:
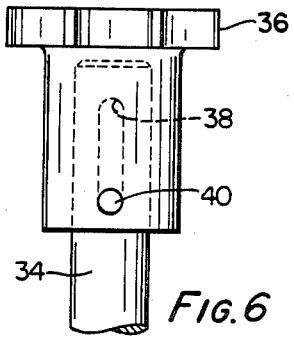
FIG. 6 is a detail of a knob forming part of the screw device.

In the arrangement shown in FIGS. 1, 3 and 7, the upper end of each screw 34 carries a knob 36 which, in the position shown in FIG. 3, is in ambush in a cavity 37 formed in the head. The upper end of the screw 34 has a slot 38 extending through it and the length of the slot is in the direction of the length of the screw. The knob 36 fits over this upper end of the screw and a pin 40 locates the knob on the screw. The pin passes through the slot and this enables the knob 36 to be lifted from the position shown in FIG. 3 relative to the screw so that the knob comes out of ambush in the cavity 37 so that a user can readily grip the knob to rotate the screw. A cover (not shown) may be fitted over the upper open end of the cavity.

When the cutting apparatus is used to cut sheet material, the apparatus is clamped on to a table top or the like 26. The material to be cut is laid on the table top with a portion beneath the strip 17 and an edge portion overlying the blade 7. The carriage is displaced along the guide and the material is severed. It is desirable to catch the trimmings and, to this end, an open topped box 50 can be secured to the heads 1 in such a manner that trimmings severed by the blade 9 fall into the box. The box may take the form of an.extruded channel of plastics or metal with an end cap at each end. When the extruded channel is removed from the apparatus, it may be used to accommodate the cutting apparatus when it is not in use.

In an alternative embodiment, the rotary wheel 9 could be a fixed knife on the carriage providing a slicing action.

What we claim as our invention and desire to secure by Letters Patent is:

1. An apparatus for cutting sheet material comprising:

an elongated beam;

a pair of head structures mounted on opposite ends of the beam, each of said head structures including clamping means for removably securing the head structure to a device, such as a table, which provides a flat work surface for supporting the material to be cut;

an elongated guide member extending from one head structure to the other head structure;

a carriage mounted on the guide member and displaceable therealong; and a cutting blade mounted on the carriage;

each of said clamping means comprising a fixed jaw and a jaw movable towards and away from the fixed jaw; the movable jaw having a nut threaded on a screw and a knob mounted on the screw to rotate the screw, the knob being displaceable relative to the screw in the direction of the length of the screw so that the knob is movable between positions in which it is in ambush in a cavity defined by the head structure and in which it is outside the head structure, respectively.

2. An apparatus as claimed in claim 1, wherein the carriage has a pair of projections which extend into slots in opposite sides of the guide member to retain the carriage on the guide member.

* * * * *